United States Patent [19]

Takeuchi et al.

[11] 4,388,068

[45] Jun. 14, 1983

[54] METAL HEATING FURNACE

[75] Inventors: Osamu Takeuchi, Mitaka; Hiroshi Hasegawa, Yokohama; Susumu Izumi, Tokyo; Naoki Otsuki, Himeji, all of Japan

[73] Assignees: Ishikawajima-Harima Jukogyo Kabushiki Kaisha; Nippon Steel Corporation, both of Tokyo, Japan

[21] Appl. No.: 288,547

[22] Filed: Jul. 30, 1981

[30] Foreign Application Priority Data

Aug. 6, 1980 [JP] Japan ..... 55-107969

[51] Int. Cl.[3] ..... F27B 9/14; F26B 5/14; F24C 3/00

[52] U.S. Cl. ..... 432/122; 126/91 A; 432/209

[58] Field of Search ..... 432/122, 146, 147, 148, 432/209; 126/91 A

[56] References Cited

U.S. PATENT DOCUMENTS

| | | | |
|---|---|---|---|
| 2,232,638 | 2/1941 | Schwalbe | 432/209 |
| 3,554,505 | 12/1981 | Dessarts | 432/122 |
| 4,214,869 | 7/1980 | Thekdi et al. | 432/209 |

OTHER PUBLICATIONS

Transactions of the Iron and Steel Institute of Japan, vol. 17, No. 5, 1977.

*Primary Examiner*—John J. Camby

*Attorney, Agent, or Firm*—Scrivener, Clarke, Scrivener and Johnson

[57] ABSTRACT

A heating furnace in which radiant tubes are extended widthwise into the furnace so that the products of combustion are discharged into the furnace, whereby intermediate shapes such as slabs which are transported through the furnace are heated to desired rolling temperatures.

6 Claims, 6 Drawing Figures

METAL HEATING FURNACE

BACKGROUND OF THE INVENTION

The present invention relates to a metal heating furnace installed upstream of a hot rolling mill so as to heat intermediate shapes such as slabs, billets or blooms to suitable rolling temperatures.

In the prior art metal heating furnaces, fuels are burned directly through burners in the furnaces so that intermediate shapes are heated to their suitable rolling temperatures mainly by energies radiated from luminous frames, gases and furnace walls.

In such a heating furnace, the mixture of fuel gases and combustion air from the burners is burned in a furnace space. Therefore, in a recently constructed heating furnace which has become very large in size (for instance, 10–15 meters in width and 30–50 meters in length), it becomes extremely difficult to attain uniform temperature distributions in the furnace especially because of the reasons to be described below:

(1) In the case of the side-fired furnace in which burners are extended through the side walls of the furnace, the flame temperature distribution must be uniform, for instance, over six meters from each side wall if the furnace is 12 meters in width. In the prior art direct-fired type heating furnace, the side burners are short in length and are opened at the side walls. As a result, even if the combustion mixture is forced to issue through the burners under high energies or pressures, the flames can propagate only from three to four meters at the longest. Therefore, the temperatures at the center portion of the furnace are considerably lower than those in the vicinity of side walls and consequently the temperature difference reaches as high as 100° C. or higher.

(2) Fuels and combustion air issued from the direct-fired burners are mixed, ignited and burned in the free space in the furnace so that the mixing conditions vary over a wide range depending upon desired combustion capacity or requirements. As a result, there exists a wide difference in temperature between the flames themselves.

(3) In addition, the smaller the combustion capacity, the shorter the flame length becomes and the lesser the energy with which the mixture of fuel and air is issued through the nozzles becomes. As a consequence, the flames are bent and staggered; that is, the flames are distrubed by the flows and floating forces of the gases in the furnace so that the flame fronts cannot reach the center portion of the furnace. Thus, a wide temperature difference results in the furnace.

(4) In a newly constructed heating furnace which increasingly becomes large in size, a walking beam or pusher must be incorporated. In this case, many water-cooled structures must be installed in the lower portion of the furnace so as to support the intermediate shapes being heated and walking beams as well. As a consequence, the arrangement of burners is structurally limited. In addition, flames fluctuate and vary their length so that the temperature difference in the furnace is further enhanced.

(5) There has been devised and demonstrated the so-called axial burner system in which the direct-fired burners are disposed longitudinally or axially of the furnace so that the above-described problems may be solved. In this case, however, in order to avoid interference with water-cooled supporting structures in the lower portion of the furnace, the burners cannot be arranged to attain an optimum condition or environment for heating the intermediate shapes. In addition, the number of burners is limited so that the capacity of each burner must be increased. Therefore, the widthwise temperature difference results in the heating furnace and is pronounced easpecially between the portions where the burners are installed and the portions where no burner is disposed. Such temperature difference cannot be neglected especially in the case a heating furnace which is installed to heat the intermediate shape to relatively low temperature, whereby it may be rolled at relatively low temperatures.

(6) When the axial burner system is employed and if the fuel consumption is reduced from its full capacity, the flames are shortened in the longitudinal or axial direction of the furnace as with the case of the side-fired furnace. As a result, a wide temperature difference occurs; that is, no uniform temperature distribution cannot be attained.

(7) In the case of the axial burner system, in order to install burners, valleys and ridges must be formed in the furnace walls. However, such arrangement inevitably interfers with a walking beam system which is disposed in the lower portion of the furnace. As a consequence, the overall design and construction of the heating furnace becomes very complex. In addition, availability of space for other devices and equipment in the vicinity of the furnace floor is limited. Moreover, maintainability and safety factors are adversely affected.

(8) The above-described phenomena are more pronounced in a heating furnace for heating the intermediate shape to relatively low soaking temperatures between 900° and 1050° C. as compared with the prior art furnaces for heating them to relatively high temperatures between 1200° and 1300° C. so that localized hot spots or localized heat concentrations tend to occur very often. This tendency may be easily verified from the fact that as shown in the following formula radiation heat transfer is proportional to the difference between the 4-th power of the heat source surface absolute temperature and the 4-th power of the intermediate shape surface absolute temperature:

$$Q = K \cdot F\left[\left(\frac{Tr}{100}\right)^4 - \left(\frac{Ts}{100}\right)^4\right]$$

where

Q=heat transfer rate (kcal/m$^2$·h),

K·F=constant,

Tr=absolute temperature of surface of heat source, and

Ts=absolute temperature of surface of intermediate shape.

In view of the above, the primary object of the present invention is to overcome the above and other problems encountered in the prior art metal heating furnace; that is, to attain uniform temperature distributions in the furnace and savings in energy, to reduce operating costs and to improve quality of steel stocks.

The present invention will become more apparent from the following description of preferred embodiments thereof taken in conjunction with the accompanying drawings.

BRIEF EXPLANATION OF THE DRAWINGS

In FIGS. 1–4 is shown a first embodiment of the present invention. In a heating furnace 1 with the width of for example 12 meters, a plurality of side burners 2 are extended widthwise from each of the side furnace walls and spaced apart from each other by a suitable distance in the longitudinal direction of the furnace 1. Each radiant tube 3 which is connected to each side burner 2 has such a length that its tip or inner end 4 reaches the longitudinal center line of the furnace 1. The radiant tubes 3 which are extended widthwise from one side furnace wall are staggered from those extended from the other side furnace wall so that interference between them may be avoided as best shown in FIG. 1. The radiant tubes 3 are supported by radiant-tube supporting members 5. Fuel and combustion air issued from the side burners 2 are mixed and burned in the radiant tubes 3 and the products of combustion are discharged through the tips 4 to the longitudinal center portion in the furnace. Reference numeral 6 denotes walking beams; 7, intermediate shapes being heated; and 8, top or ceiling burners.

Figure 1:
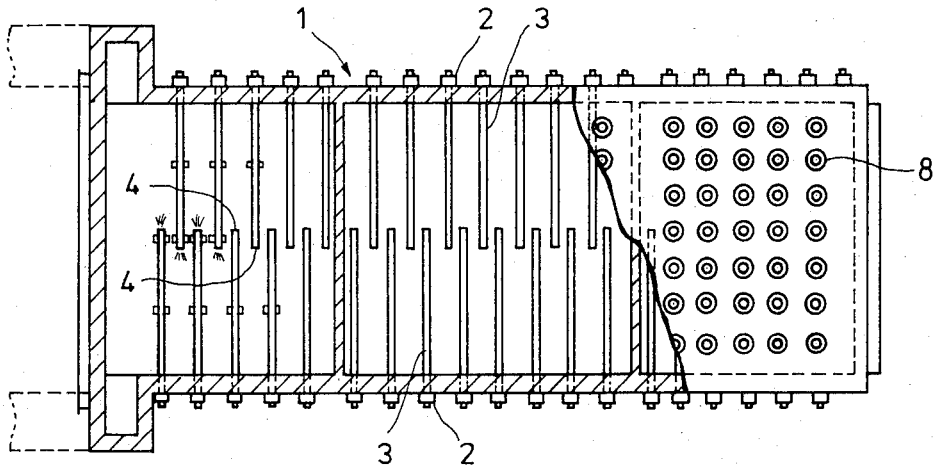
FIG. 1 is a top view of a first embodiment of the present invention with the top wall partly cut away.
Figure 2:
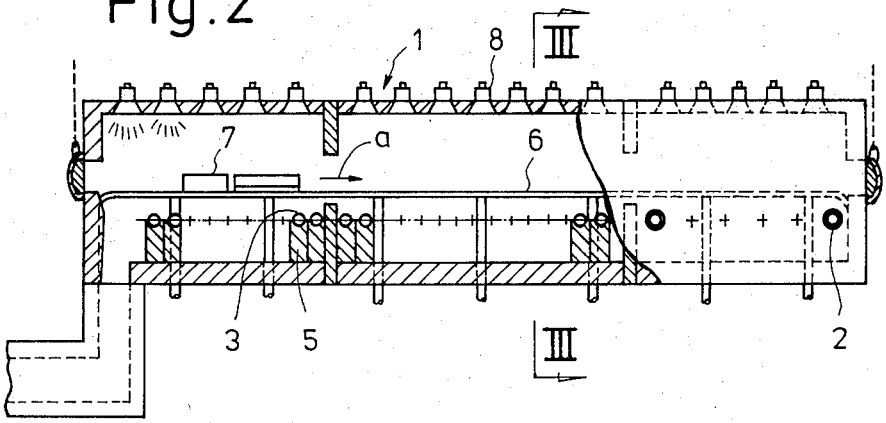
FIG. 2 is a side view thereof.
Figure 3:
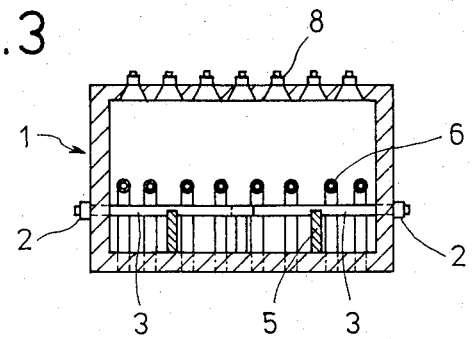
FIG. 3 is a sectional view taken along the line III—III of FIG. 2.

In operation, the intermediate shapes 6 are placed on the walking beams 6 which are driven by a driving device (not shown) disposed on the floor of the furnace 1 so that the intermediate shapes 7 are transported through the furnace 1 in the direction indicated by the arrow a in FIG. 2. The top sufaces of the intermediate shapes 7 are uniformly heated by the top burners 8 while the bottom surfaces thereof, by the side burners 2.

Figure 4:
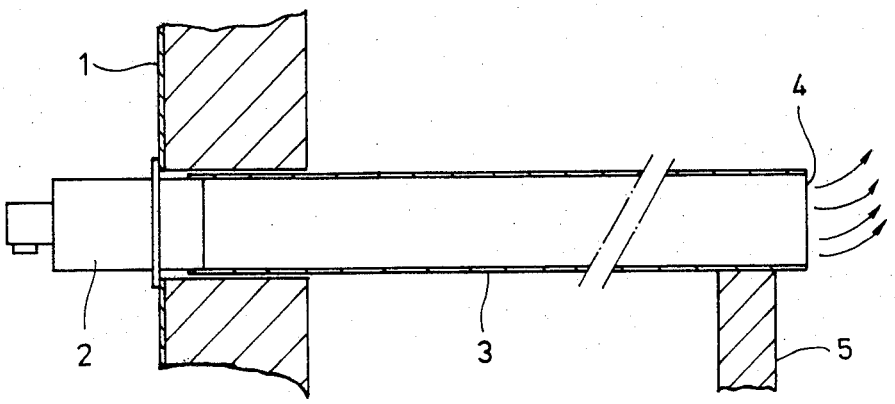
FIG. 4 is a view, on enlarged scale, of a radiant tube used in the present invention.

As best shown in FIG. 4, the radiant tube 3 is so extended widthwise that its open inner end 4 may be located at the longitudinal center portion of the furnace. Fuel and combustion air issued from the side burner 2 are mixed and burned in the radiant tube 3 and the products of combustion are discharged widthwise through the inner end 4 toward the center portion of the furnace. Since the combustion takes place within the radiant tube 3, the flame propagation is not disturbed by turbulences of gases in the furnace so that regardless of the fuel consumption the relatively satisfactory temperature distribution can be attained over the length of the radiant tube 3.

According to the present invention, the heating operation may be switched so as to heat the intermediate shapes 7° to 1250° C. or to temperatures between 900° and 1000° C.

Figure 5:
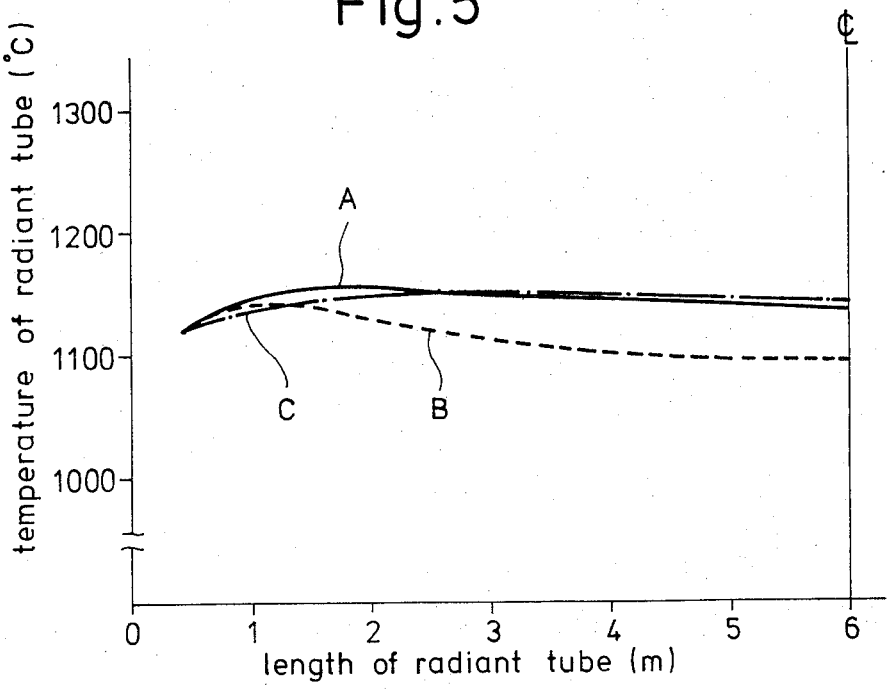
FIG. 5 shows an example of the temperature distribution over the length of the radiant tube.

FIG. 5 shows the temperature distributions attained when the radiant tubes 3 which are 300 mm in outer diameter and 6 m in length were disposed with a pitch of about 1.5 m. The solid line curve A shows the temperature distribution when the fuel consumption was 100% and the dotted-line curve B, when the fuel consumption was 30%. These temperature distributions are very satisfactory. In the case of the prior art heating furnace, the temperature difference is higher than 100%, but according to the present invention, the temperature difference in the furnace is within 50° C. and the temperature difference in the intermediate shape 7 can be suppressed within less than 30° C.

The radiant tubes 3 can be securely supported by the supporting members 5 in such a way that no extermal force is exerted to them. As a result, in the design and fabrication of the radiant tubes 3, it suffices only to take their resistance to heat taken into consideration. In order that the radint tubes 3 may be used continuously even when some cracks propagate in them or even if they are bent, it is preferable that they be made of heat-resisting steel or ceramics.

Figure 6:
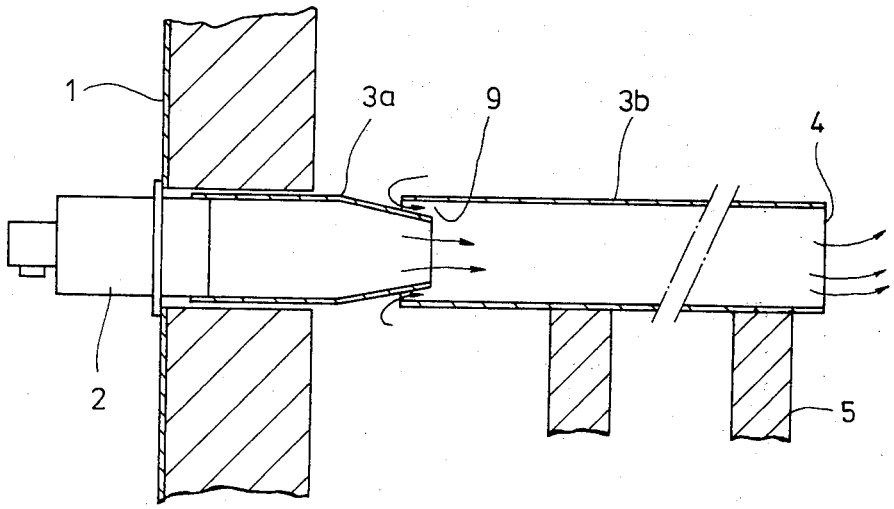
FIG. 6 is a sectional view of another radiant tube used in the present invention.

In FIG. 6 is shown another embodiment of the present invention; that is, a radiant tube 3 consisting of a first section 3*a* with a spigot-like or tapered end and a second section 3*b* with a uniform diameter throughout its length. The first and second radiant tube sections 3*a* and 3*b* are so connected that an annular gas-suction opening 9 may be defined between them. Therefore the gases; that is, the products of combustion can be recirculated through the second radiant tube section 3*b* so that the temperature distribution over the length of the radiant tube 3 can be further improved as indicated by the one-dot chain-line curve C in FIG. 5.

So far the combination of the top and side burners 8 and 2 has been used, but it is to be understood that a combination of axial burners for heating the upper surfaces of the intermediate shapes and axial burners with radiant tubes for heating the undersurfaces of the shapes may be employed. In addition, any other suitable combinations of burners may be used. So far the inner open ends 4 of the radiant tubes have been described as being located at the longitudinal center line portion of the furnace, but it is to be understood that they may be located at any suitable positions.

In summary, the present invention can solve substantially the problem of localized hot spots or heat concentrations which is inherent to the prior art metal heating furnace. In addition, in order to attain the use of the furnace bed with a higher degree of efficiency, a plurality of radiant tubes with open inner ends are extended widthwise in the lower portion of the furnace so that the combustion takes place in a relatively elongated (limited) space and the products of combustion are discharged into the furnace through the open inner ends of the radiant tubes. As a result, the following excellent and new effects and advantages are obtained:

(1) Since the combustion takes place within the radiant tubes, energies are radiatated from the solid radiation surfaces so that stabilized radiation may be ensured and consequently the temperature difference may be minimized.

(II) Since the combustion takes place in the radiant tubes, the flames are not disturbed by turbulances of gases in the furnace and can be propagated to any desired point so that, regardless of the fuel consumption, a relatively uniform temperature distribution can be attained and maintained.

(III) Because of (II) above, small-capacity burners can be disposed in many numbers without causing any adverse interference so that the effective radiation-surface area within the heat transfer rate can be increased. As a result, the heat transfer rate can be increased and the intermediate shapes can be heated satisfactorily to relatively low temperatures. Moreover, because of the increase in thermal efficiency, the use of excessive fuel can be avoided; that is, saving in energy can be attained.

(IV) Regardless of the fuel consumption, the flames and the products of combustion are made to flow through the radiant tubes so that the temperature difference along the length of the radiant tube can be minimized; that is, a uniform temperature distribution can be maintained. Especially when the fuel consumption is reduced to less than one third, maintainability of uniform temperature distribution can be improved as compared with the prior art heating furnace.

(V) The inner ends of the radiant tubes are opened so that the products of combustion can be distributed to any desired parts of furnace so that heat transfer by convection can be also attained and consequently the thermal efficiency can be further improved.

(VI) The radiant tubes are heat conductive, are not subjected to the external forces and are not needed to be completely gas tight so that even when they are cracked or bent, they can be used for a long period of operation; that is, their life expectancy can be increased.

(VII) A sufficiently uniform temperature distribution can be attained and maintained with the side burners. As a result, the construction of the heating furnace and especially the lower portion thereof can be simplified so that maintainability can be improved and safety can be ensured. In addition, saving in initial cost can be attained.

(VIII) Because of the effects and features described above, even in the heating furnace adapted to switch its heating operations for heating the intermediate shapes to temperatures between 1200° and 1300° C. and to temperatures between 900° and 1000° C.; that is, in the heating furnace whose heating temperature is varied over a wide range, a uniform temperature distribution throughout the furnace can be ensured. As a result, the heated intermediate shapes can be improved in quality.

What is claimed is:

1. A metal heating furnace comprising:

(a). a substantially closed chamber having side walls, a top, a bottom, an entrance end, an exit end, a horizontal walking beam intermediate the top and bottom and extending from the entrance end to the exit end, and (b). means for heating a work piece on the walking beam comprising:

i. a plurality of substantially horizontal radiant heating tubes extending from each side wall and spaced along the length of the chamber and adjacent the walking beam and each having an open end adjacent the longitudinal center line of the chamber, and ii. means at the side wall end of each tube closing that end of the tube, said means being constructed, adapted and operable to discharge fuel and air into the connected tube for combustion within the tube.

2. A metal heating furnace according to claim 1 wherein said radiant tubes are disposed below and adjacent the walking beam.

3. A metal heating furnace as set forth in claim 1 in which each radiant tube is divided into a first section connected to the side wall and a separate section between the first section and the center line of the chamber, the inner end of the first section being reduced in diameter with respect to the adjacent open end of the separate section and positioned within it, thereby to provide an annular suction opening for furnace gas.

4. A metal heating furnace according to claim 1, in which adjacent tubes extending from the opposite side walls are staggered longitudinally of the chamber.

5. A metal heating furnace according to claim 1, in which the open ends of the tubes are in the longitudinal center line of the chamber.

6. A metal heating furnace according to claim 1, in which the tubes extend beyond the longitudinal center line of the chamber.

* * * * *